United States Patent [19]

Morrow

[11] 3,964,570

[45] June 22, 1976

[54] SILENCER FOR COMBUSTION ENGINES

[76] Inventor: Raymond A. Morrow, 601 S. East St., Anaheim, Calif. 92805

[22] Filed: Aug. 22, 1975

[21] Appl. No.: 606,867

[52] U.S. Cl. ..... 181/56; 181/57; 181/66

[51] Int. Cl.[2] ..... F01N 1/10

[58] Field of Search ..... 181/41–42, 181/46, 47 R, 47 B, 48–50, 56–59, 63, 66, 68–70

[56] References Cited

UNITED STATES PATENTS

| | | | |
|---|---|---|---|
| 1,821,013 | 9/1931 | Hamilton | 181/70 |
| 1,881,051 | 10/1932 | Haas | 181/49 |
| 2,158,030 | 3/1939 | Latulippe | 181/56 |
| 2,855,068 | 10/1958 | Chapel | 181/47 R X |
| 3,180,712 | 4/1965 | Hamblin | 181/48 X |
| 3,770,081 | 11/1973 | Martin | 181/47 R X |

*Primary Examiner*—Lawrence R. Franklin

[57] ABSTRACT

A silencer for relatively low horsepower combustion engines is constructed with two separate sections in series through which exhaust gases pass. The upstream section has two concentric perforated tubes within an imperforate jacket with exhaust openings from the tubes discharging into a vestibule. From the vestibule gases are directed in a circumferential path as they enter a second series of concentric perforated tubes within the jacket, the gases being passed first to a chamber between the jacket and the outermost tube and from there through perforations in the walls of the tubes to an exhaust outlet port.

8 Claims, 7 Drawing Figures

SILENCER FOR COMBUSTION ENGINES

It is commonly appreciated that combustion engines of relatively low power used on motor scooters and motorcycles, as well as some of those higher power, are to a large degree noisy and that the muffling problem has not been one easily solved especially in view of current regulations respecting noise abatement.

While it is true that such silencers can and have been built, there are physical limitations as well as economic limitations which make the employment of currently available silencers inexpedient. Such vehicles, for example, are for the most part rather small and space is limited. Consequently an acceptable silencer must be one which does not take up too much room. Additionally, such small vehicles are in the relatively inexpensive category and for silencers to be acceptable they also must be of inexpensive construction but, at the same time, be effective. Furthermore, the technical characteristics of a silencer for combustion engines of the kind made reference to must not be such as to generate undesired back pressure in order to make certain that performance of the engine is not unduly impaired.

It is therefore among the objects of the invention to provide a new and improved silencer for relatively small combustion engines which is relatively light in weight, relatively inexpensive to manufacture and which, at the same time, is sufficiently effective to reduce engine exhaust noise to an acceptable minimum.

Another object of the invention is to provide a new and improved silencer for lightweight or low horsepower combustion engines which is compact in its design as well as light in weight sufficient to be effectively used on vehicles such as motor scooters and motorcycles and combustion engines of the type used on small vehicles such as lawnmowers and carts.

Still another object of the invention is to provide a new and improved low-cost sheet metal silencer of such construction that although relatively short in the sense of physical measurement, it nevertheless provides a relatively long path for combustion gases, thereby to achieve a silencing effect comparable to those achieved by relatively long silencers of the type heretofore available.

Also included among the objects of the invention is to provide a new and improved silencer virtually all parts of which consist of two or three sheet metal stampings which can be quickly and easily assembled with a minimum amount of tooling to produce a highly effective silencing device.

With these and other objects in view, the invention consists in the construction, arrangement, and combination of the various parts of the device, whereby the objects contemplated are attained, as hereinafter set forth, pointed out in the appended claims and illustrated in the accompanying drawings.

In the drawings:

FIG. 1 is a side elevational view of the silencer.

FIGS. 2*a* and 2*b* are longitudinal sectional views which taken together comprise a longitudinal sectional view on the line 2—2 of FIG. 1

Figure 1:
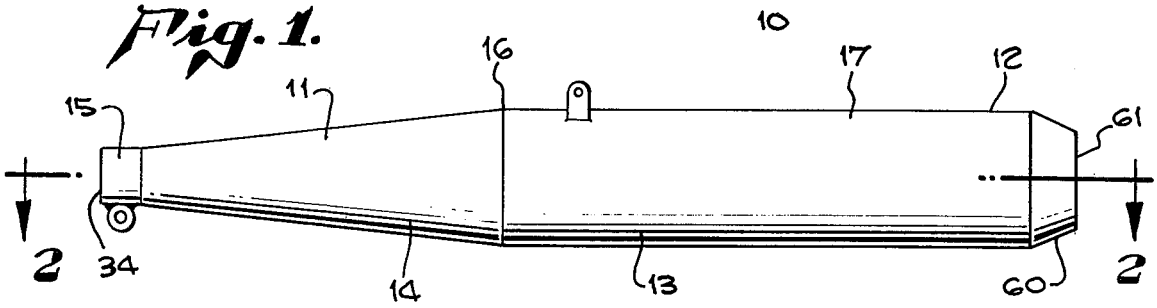

In an embodiment of the invention chosen for the purpose of illustration, there is shown an elongated jacket indicated generally by the reference character 10 which consists of an upstream chamber section 11, a downstream chamber section 12 and a vestibule section 13.

That portion 14 surrounding the upstream chamber section has a cross section expanding progressively from a cylindrical entrance band 15 to an edge 16 of a cylindrical portion 17 of larger diameter and which houses the vestibule section 13 and downstream chamber section 12.

Within the upstream chamber section 11 are respective concentric diametrically spaced outer and inner tubes 18 and 19. The outer tube 18 is substantially cylindrical throughout its length except for a short tapered section 20 at the upstream end. The outer tube is provided with a series of perforations 21 extending throughout its entire length.

There is an opening 22 at the upstream end and an opening 23 of comparable size at the downstream end. The upstream chamber section 11, previously referred to, is the space between the outside surface of the outer tube and the inside surface of the respective portion 14 of the jacket.

An annular collar 24 which is imperforate has a sealed connection 25 at its outer periphery to the inside surface of the cylindrical portion 17 of the jacket. The collar is imperforate and extends obliquely inwardly and in an upstream direction to an annular line 26 of engagement with the exterior surface of the outer tube 18.

The inner tube 19 is spaced at its upstream end from the outer tube 18 by an enlargement 27 which is a portion of the metal of the inner tube expanded outwardly in a flare-like shape to meet a reversely flared band 28 which is welded to the inside surface of the outer tube 18.

At the downstream end of the inner tube there is a similar outwardly flared enlargement 29 which expands outwardly to meet a cylindrical band 30 welded to the inside surface of the downstream end of the outer tube 18.

Pointed tabs 31 are punched from the material of the inner tube 19 in staggered relationship providing openings 32 and transverse surfaces 33 which face the flow of exhaust gases entering an inlet 34 adjacent the cylindrical entrance band 15. The opening 23 provides an outlet for the spaced tube arrangement.

Figure 2A:
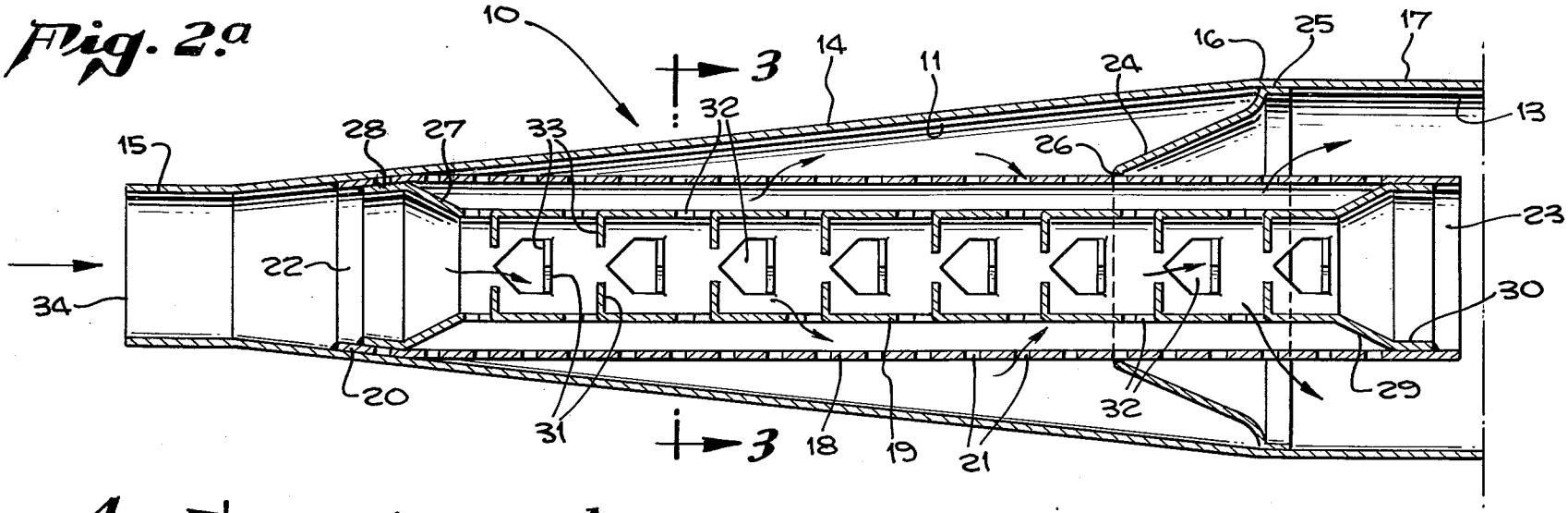
Figure 2B:
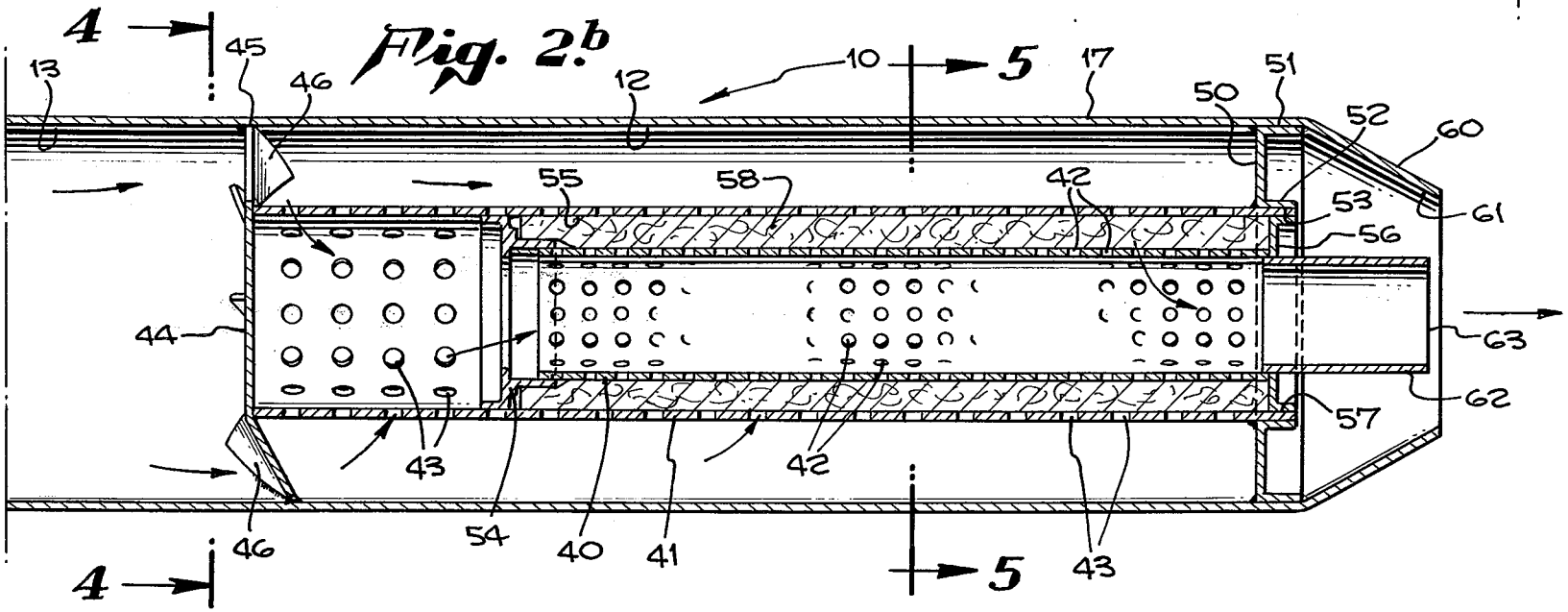

A second pair of respective inner and outer concentric tubes 40 and 41 occupy the midportion of the downstream chamber section 12 as shown in FIG. 2*b*, the downstream chamber section 12 being a cylindrical space lying between the outside surface of the outer tube 41 and the inside surface of the respective cylindrical portion 17 of the jacket 10.

The inner tube is provided with a multiplicity of perforations 42 and the outer tube is provided with a comparable multiplicity of perforations 43.

Figure 4:
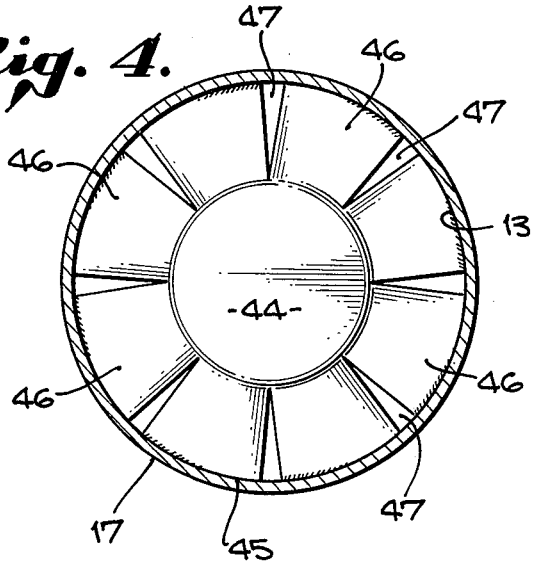
FIG. 4 is a cross-sectional view on the line 4—4 of FIG. 2*b*.
Figure 6:
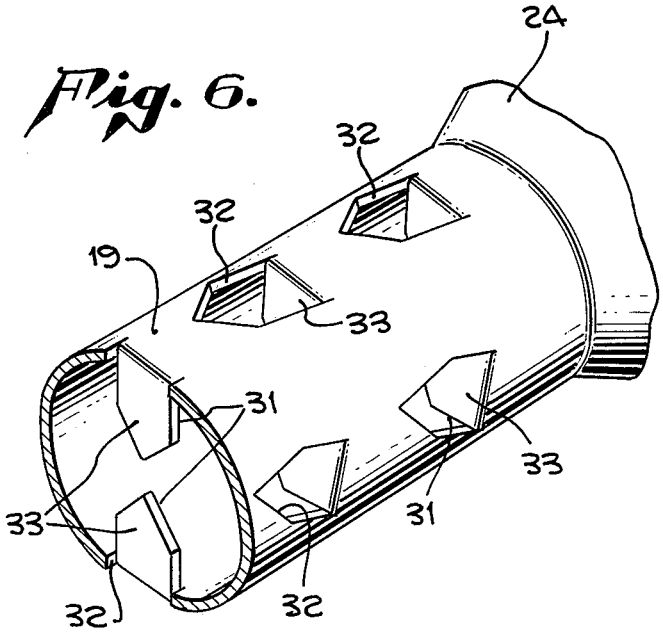
FIG. 6 is a fragmentary perspective view of the downstream end of the inner tube at the upstream portion of the device.
Figure 5:
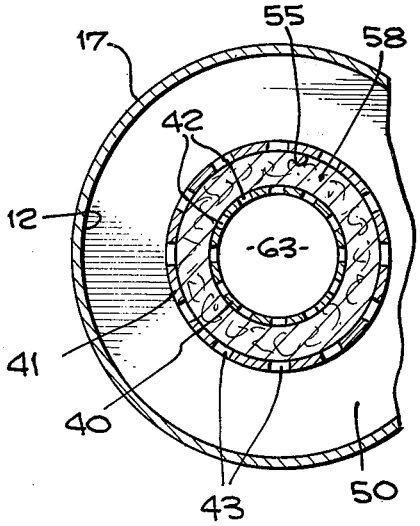
FIG. 5 is a cross-sectional view on the line 5—5 of FIG. 2*b*.

Closing the upstream end of the outer tube 41 is a baffle 44 an outermost circumference 45 of which is welded into the inside surface of the cylindrical portion 17. Although the central area of the baffle 44 is imperforate thereby to close the end of the outer tube 41, an annular portion of the baffle located between the outer tube 41 and the cylindrical portion 17 is provided with a set of circumferentially spaced vanes 46, best shown in FIG. 4. The vanes are tilted obliquely as shown in FIG. 2*b* and provide openings 47 between them through which exhaust gases can pass. The direction of tilt of the vanes is made such that when exhaust gases impinge against them, the path given to the gases is a spiral path as it enters and proceeds through the downstream chamber section 12 thereby to effectively lengthen the path of travel of the gases without need for actually lengthening the structure itself.

At the downstream end of the outer tube 41 is a collar 50 having a cylindrical outer band 51 welded in sealing engagement with the inside surface of the cylindrical portion 17. A band 52 is welded to the downstream end of the outer tube 41, as shown at the right-hand end of FIG. 2*b*. There is obviously an opening 53 at the downstream end of the outer tube 41 through which the tube extends.

The inner tube 40 at its upstream end has a flared enlargement 54 which is welded to the inside surface of the outer tube 41, thereby to seal the connection and close the respectively adjacent end of a space 55 which lies between the tubes 40 and 41. Another flared enlargement 56 at the downstream end of the inner tube 40 has a sealed engagement 57 with the inside surface of the downstream end of the outer tube 41. The flared enlargement 56 is imperforate thereby effectively closing the downstream end of the space 55. When desired the space 55 may be filled with a fibrous or flocculent filler 58 such as glass wool, glass beads or comminuted asbestos by way of example.

At the exhaust end of the jacket 10 is an outflow deflector 60 which extends obliquely inwardly and endwardly toward the longitudinal center line of the device. The angle shown in FIG. 2*b* is an angle of substantially 30° but the deflection may vary to some extent from a 30° angle by one as small as 20° or one as large as 40°. At the outermost end of the outflow deflector is an opening 61. A cylindrical pipe 62 at the downstream end of the inner tube 40 has a diameter smaller than the opening 61, thereby giving to the opening 61 an annular form. An exhaust opening 63 at the outflow end of the pipe 62 terminates just inside of the opening 61. The relationship of outflow deflector, pipe 62 and respective openings, comprises an effective expedient for reducing the noise of emission of exhaust gases from the silencer.

It is also significant that when the vestibule section 13 is as long as shown in proportion to other elements of the device that the combined outer and inner tubes 18, 19 at the upstream end of the jacket extend a substantial distance into the vestibule section so that the endmost edges of the tubes are more or less midway between opposite ends of the vestibule section 13. On those occasions where the vestibule section may be shorter, the protrusion of the tubes into the vestibule section may be cut down appreciably.

Figure 3:
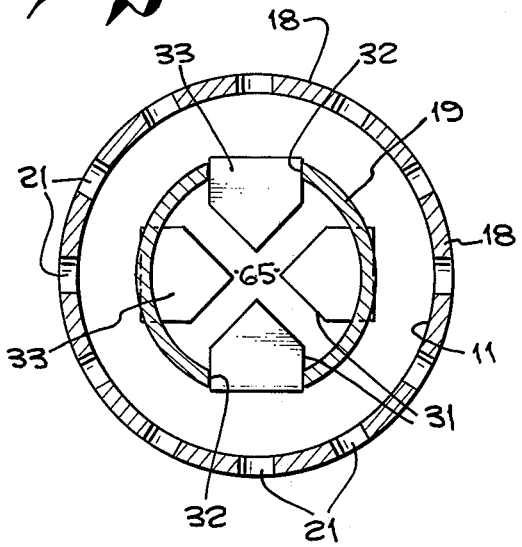
FIG. 3 is a cross-sectional view on the line 3—3 of FIG. 2*a*.

In operation exhaust gases enter at the inlet end 34 and are driven into the interior of the inner tube 19. As shown in FIG. 3, there is a straight-through passage for a portion of the gases in an area 65 central with respect to the tips of the tabs 31. This area, however, is insufficient to accommodate all of the exhaust gases, the remainder of which impinges upon the transverse surfaces 33 creating turbulence and directing a substantial portion of exhaust gases outwardly through the openings 32 into the space between the inner and outer tubes.

From here a substantial portion of the exhaust gases finds its way outwardly through the perforations 21 into the upstream chamber section 11. Gases however do not remain in the upstream chamber section but are merely agitated and ultimately are directed back through the perforations 21 into the space between the tubes and then ultimately out through those perforations near the downstream end of the outer tube 18 which lie within the vestibule section 13. Some gases may find their way back through the openings 32 into the inner tube 19 and thus to pass through the opening 23 into the vestibule section 13.

From the vestibule section, the gases, deflected by the vanes 46, are steered in a somewhat circumferential spiral-like direction swirling around the outside surface of the outer tube 41 within the downstream chamber section 12, and this spiral-like path continues substantially throughout the length of the downstream chamber section 12.

Some gases concededly pass through those perforations 43 at the upstream end of the tube 41 where no inner tube 40 is present. These gases find their way directly through the center of the inner tube. Others of the gases and, in fact, the majority of the exhaust gases which are directed into the downstream chamber section 12, find their way back through those perforations 43 of the outer tube 41 which overlie the inner tube 40.

The gases continue to pass through the space 55 and, when there is a filler 58 present also through the filler, to the perforations 42 of the inner tube 40 and, thence, outwardly through the pipe 62 to atmosphere.

The turbulence generated by the particular construction of the parts described as well as the effective increase in the length of path of travel of the gases provides an effective silencing effect for exhaust gases while at the same time preserving the desired efficiency in the combustion engine to which the silencer is attached.

Which the invention has herein been shown and described in what is conceived to be a practical and effective embodiment, it is recognized that departures may be made therefrom within the scope of the invention, which is not to be limited to the details disclosed herein but is to be accorded the full scope of the claims so as to embrace any and all equivalent devices.

Having described the invention, what is claimed as new in support of Letters Patent is:

1. A silencer for attachment to the exhaust pipe of relatively low horsepower combustion engines comprising an elongated jacket with a chamber therein having an upstream entrance end and a down stream exhaust outlet end, said chamber having an upstream chamber section, a downstream chamber section and an intermediate vestibule section, a pair of mutually spaced concentric tubes in the upstream chamber section, with the outer tube diametrically spaced from the jacket, both said tubes having perforations through the walls, and an imperforate annular collar extending around and in engagement with the outer tube adjacent the downstream end and in sealing angagement with the jacket, a deflecting baffle extending across the downstream end of the vestibule section, said baffle havng a circumferentially disposed series of deflector vanes with openings therebetween, the vanes being pitched obliquely relative to the longitudinal axis of the downstream section whereby to impart a spiral direction to exhaust gas passing therethrough, a pair of diametrically spaced concentric tubes in the downstream section, both said last identified tubes having perforations through the respective walls, the outer tube being spaced radially inwardly from the jacket forming a substantially cylindrical space, and a collar between the jacket and the tubes closing the cylindrical space and the space between said tubes, said collar having a central opening therein for the inner tube and an annular outflow deflector on the downstream end of the jacket extending to an annular edge forming an opening spaced radially outwardly with respect to the circumference of the inner tube.

2. A silencer as in claim 1 wherein the inner tube of the downstream chamber section is shorter than the outer tube and has its upstream end spaced at a greater distance from the deflector vanes than the upstream end of the outer tube.

3. A silencer as in claim 1 wherein the downstream ends of the inner and outer tubes of the upstream chamber section extend into the vestibule section a distance in excess of the diameter of the outer tube.

4. A silencer as in claim 1 wherein the downstream end of the inner tube of the downstream chamber section extends outwardly to a location substantially coinciding with opening in the outflow deflector.

5. A silencer as in claim 1 wherein the outflow deflector extends from the jacket obliquely inwardly and endwardly at an angle of between 20° and 40° relative to the longitudinal axis of the jacket.

6. A silencer as in claim 5 wherein the angle is about 30°.

7. A silencer as in claim 1 wherein space between the inner and outer tubes of the downstream chamber section is filled with an inorganic flocculent packing.

8. A silencer as in claim 1 wherein the annular collar at the downstream end of the upstream chamber section extends in a direction obliquely inwardly and upstream to its engagement with the respective outer tube.

* * * * *